US005332355A

United States Patent [19]

Lyda, Jr.

[11] Patent Number: 5,332,355

[45] Date of Patent: Jul. 26, 1994

[54] IMPELLING APPARATUS

[75] Inventor: Eldon L. Lyda, Jr., Athens, Tex.

[73] Assignee: Pamela Kittles, Athens, Tex.

[21] Appl. No.: 986,453

[22] Filed: Dec. 7, 1992

[51] Int. Cl.[5] ..... F04D 3/00

[52] U.S. Cl. ..... 415/74; 415/218.1; 415/219.1

[58] Field of Search ..... 415/71, 72, 73, 74, 415/218.1, 219.1, 220, 221; 416/176, 177, 188; 60/221

[56] References Cited

U.S. PATENT DOCUMENTS

| | | | |
|---|---|---|---|
| 237,728 | 2/1881 | Card . | |
| 431,090 | 7/1890 | Waterhouse | 415/74 |
| 451,086 | 4/1891 | Toliver . | |
| 461,051 | 10/1891 | Seymour . | |
| 464,898 | 12/1891 | Rooke . | |
| 1,422,384 | 7/1922 | South . | |
| 1,430,141 | 9/1922 | Angus | 415/218.1 |
| 1,795,588 | 3/1931 | Wilson . | |
| 1,874,450 | 8/1932 | Coats | 415/72 |
| 2,040,452 | 5/1936 | Troller . | |
| 2,483,335 | 9/1949 | Davis | 415/218.1 |
| 2,636,467 | 4/1953 | Johnson . | |
| 2,647,467 | 8/1953 | Davis . | |
| 3,050,007 | 8/1962 | Rydz . | |
| 3,143,857 | 8/1964 | Eaton . | |
| 3,168,048 | 2/1965 | Toyokura et al. . | |
| 3,174,454 | 3/1965 | Kenefick . | |
| 3,225,537 | 12/1965 | Parsons . | |
| 3,286,641 | 11/1966 | Delao et al. . | |
| 3,756,741 | 9/1973 | Woell . | |
| 3,906,886 | 9/1975 | Elger . | |
| 3,936,225 | 2/1976 | Stjernstrom | 415/218.1 |
| 4,707,978 | 11/1987 | Cascajosa . | |
| 4,708,585 | 11/1987 | Fukazawa et al. . | |
| 4,838,819 | 6/1989 | Todorovic . | |
| 4,880,352 | 11/1989 | Aarestad . | |
| 4,909,711 | 3/1990 | Burgbacher et al. . | |

FOREIGN PATENT DOCUMENTS

| | | | |
|---|---|---|---|
| 567600 | 3/1924 | France | 415/218.1 |
| 21314 | 3/1911 | Netherlands | 416/188 |
| 849744 | 9/1960 | United Kingdom | 415/218.1 |

*Primary Examiner*—Edward K. Look
*Assistant Examiner*—James A. Larson
*Attorney, Agent, or Firm*—Pravel, Hewitt, Kimball & Krieger

[57] ABSTRACT

This invention relates to an impelling device having a suction casing having an axially located intake port, and providing a conically shaped suction cavity, and an impeller located within the conically shaped suction cavity having a conically shaped impeller hub and a plurality of vanes extending radially outward from the outer surface of the impeller hub. The impelling apparatus may further include a discharge casing providing a conically shaped discharge cavity in which is mounted a conically shaped discharge hub.

6 Claims, 4 Drawing Sheets

IMPELLING APPARATUS

BACKGROUND OF THE INVENTION

1. Field of the Invention

The invention generally relates to devices for impelling fluids. More particularly, the invention relates to a device for impelling fluids, especially liquids, at relatively high flow rates and relatively low differential pressures by means of conically diverging rotating vanes operating within a conically diverging annular casing space.

2. Description of the Related Art

Conventional centrifugal impelling devices, such as pumps and compressors, utilize a set of rotating vanes, constituting an impeller, operating in a stationary casing. The rotating vanes accelerate the incoming fluid to a higher velocity. The fluid is discharged from the periphery of the impeller and the major portion of the velocity energy is then converted into pressure energy by means of the stationary casing. However, in certain specific applications, such as jet pump drives for watercraft, it is desirable to produce relatively low differential pressures and retain most of the velocity energy imparted to the fluid so that it may be expelled from the casing as a high velocity jet.

Centrifugal impellers are generally classified, according to the major direction of flow in reference to the axis of rotation, as radial flow, axial flow, or mixed flow. Mixed flow impellers combine radial and axial flow characteristics and are widely applied where relatively high fluid flow rates must be delivered at relatively low differential pressures. Such applications include, for example, the aforementioned jet pump drives for watercraft.

The phenomenon known as cavitation is of critical importance in impellers employed in liquid service and may be described as follows. As the liquid entering the impeller is accelerated by the impeller vanes, the pressure of the liquid drops suddenly due to the increase in velocity. Should the absolute pressure of the liquid at the impeller inlet drop below the vapor pressure of the liquid at the operating temperature, some of the liquid will vaporize and bubbles of vapor will be carried into the impeller. These vapor bubbles will collapse violently at some point downstream of the impeller inlet, usually within the impeller itself. The collapse of these vapor bubbles in the impeller produces excessive noise and vibration, and often physically damages impeller surfaces. In addition to the physical damage it causes, cavitation diminishes impeller performance and results in undesirable discharge pressure fluctuations as vapor bubbles form and subsequently collapse.

Attempts have been made to minimize cavitation by eliminating the sudden acceleration of the liquid as it enters the impeller. Screw type devices of gradually increasing diameter in the direction of flow, known generally as inducers, have been installed on impeller inlets. These devices gradually accelerate the liquid and induce it to rotate as it approaches the impeller vanes. The rapid shock acceleration associated with cavitation is thus reduced or eliminated.

Inducers are well suited for use on radial flow impellers which generally have defined inlet ports providing both space for the installation of an inducer and adequate clearance between the leading edge of the vanes and the face of the impeller. In contrast to radial flow impellers, mixed flow impellers generally lack defined inlet ports since the leading edges of the vanes often project forward from the impeller hub into the fluid flow stream. Consequently, inducers are not well suited for installation on mixed flow impellers.

Additionally, despite being somewhat successful in minimizing cavitation, inducers are a device which must be attached to conventional impellers and represent added manufacturing costs and an additional component which may require maintenance or replacement over time.

Therefore, there is a need for a mixed flow impelling apparatus which provides satisfactory performance while minimizing the likelihood of cavitation in liquid service.

SUMMARY OF THE INVENTION

The present invention is directed to providing a means for impelling fluids, particularly liquids, at relatively high flow rates and relatively low differential pressures. The device of the present invention imparts velocity energy to a fluid in a mixed radial and axial flow regime. The fluid's velocity is increased uniformly as it passes through the device such that the likelihood of cavitation in liquid service applications is minimized or eliminated. The fluid exits the device at relatively high velocity such that it is useful in applications where a fluid jet is required.

The present invention utilizes a rotating multi-vane impeller operating within a stationary casing. The vanes have a helical twist opposed to the direction of rotation and are arranged on a conically shaped impeller hub which diverges conically from the impeller inlet. The cavity of the stationary casing in which the impeller operates also diverges conically from the fluid inlet. The impeller hub and the conical casing cavity surrounding the impeller hub are proportioned so that the fluid maintains a constant or decreasing volume as it progresses along the impeller hub, i.e., the incremental volume at the suction section of the impeller is equal to or greater than the incremental volume at the discharge end of the impeller. It is believed that this provides for a significantly reduced occurrence of cavitation.

Although a number of discharge configurations are possible depending upon the specific application, the preferred embodiment includes a discharge nozzle which serves to further increase the fluid's velocity after it exits the impeller while eliminating the rotational component of the flow. In this embodiment, the discharge casing contains a centrally mounted, stationary conical hub. The diameter of the discharge hub in the plane of its junction with the suction casing wall section is preferably the same as the maximum impeller hub diameter. The discharge casing cavity converges conically toward the discharge nozzle, as does the conical discharge hub. The fluid exiting the impeller and entering the discharge casing may be forced to pass through an annular space of progressively decreasing cross-sectional area, thus further accelerating the fluid as it approaches the discharge nozzle.

The present invention provides an impelling device which imparts significant velocity energy to a fluid while developing a relatively low differential pressure.

The present invention also provides an impelling device which allows pumping a liquid with significantly reduced occurrence of cavitation.

BRIEF DESCRIPTION OF THE DRAWINGS

A better understanding of the invention can be obtained when the detailed description of exemplary embodiments set forth below is considered in conjunction with the attached drawings, in which.

DETAILED DESCRIPTION OF EXEMPLARY EMBODIMENTS

The present invention provides a means for impelling fluids at relatively high flow rates and relatively low differential pressures. The device of the present invention imparts velocity energy to a fluid in a mixed radial and axial flow regime.

Figure 1:
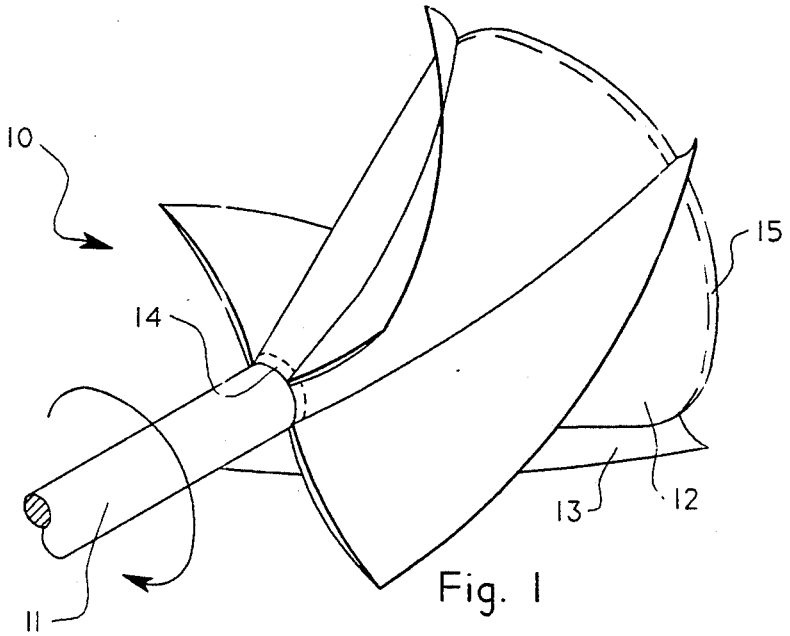
FIG. 1 is a view of the impeller comprising a shaft, impeller hub and multiple vanes.
Figure 2:
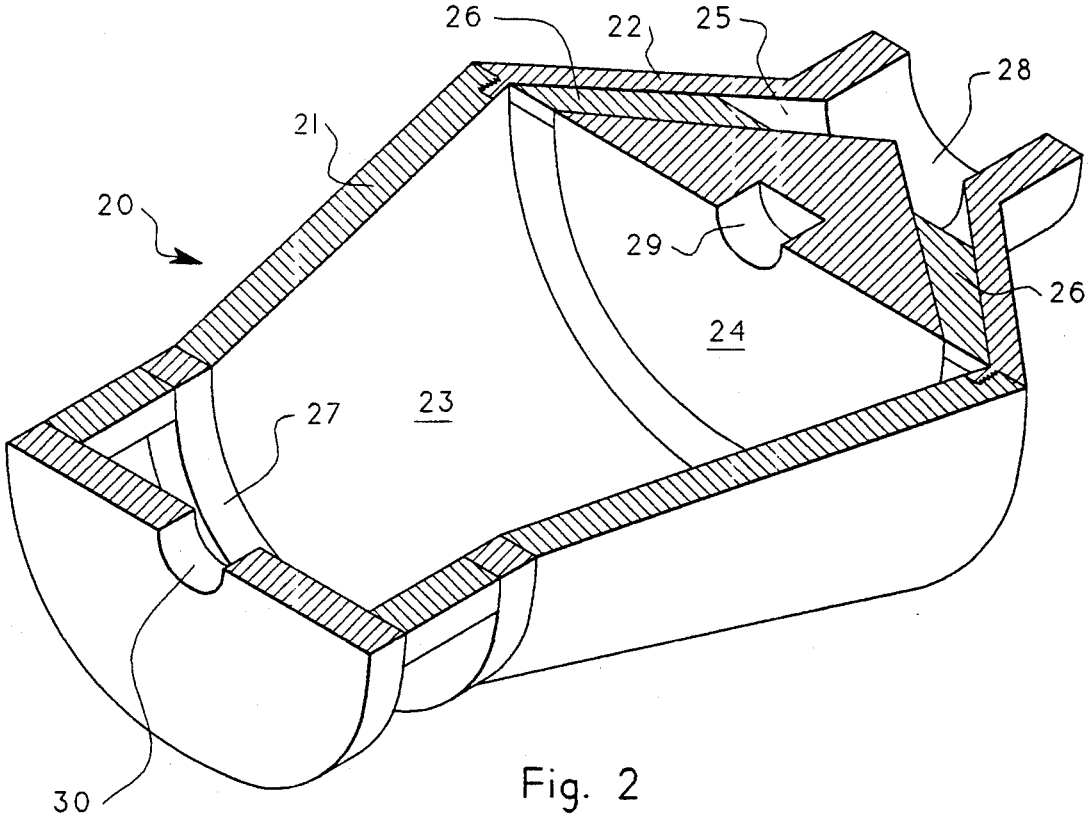
FIG. 2 is a sectional view of a casing for the impeller of FIG. 1.

FIGS. 1 and 2 show one embodiment of an impelling device which is formed of four major components: (1) an impeller 10 comprising a shaft 11 and a conical impeller hub 12 with vanes 13 mounted thereon; (2) a suction casing wall 21 forming a conically shaped suction cavity 23; (3) a discharge casing wall 22 forming a conically shaped discharge cavity 25; and (4) a stationary conical discharge hub 24. In general, impeller 10 is rotatably mounted within the conically shaped suction cavity 23 of casing 20 and shaft 11 is connected to a motor or driver (not shown) which rotates the impeller 10. The fluid enters the casing 20 through intake port 27 and advances both axially and radially along the rotating impeller hub 12. The fluid further advances through the annular space between the discharge casing wall 22 and the centrally mounted stationary conical discharge hub 24 and exits the casing 20 through discharge port 28 with a significantly increased velocity.

The impeller 10 comprises a shaft 11 on which a conically shaped impeller hub 12, with vanes 13, is mounted. To facilitate discussion, the impeller hub 12 is designated as having two sections; a "suction section" 14 which is that initial part of the impeller hub 12 which first contacts the fluid entering the intake port and a "transition section" 15 which is that part of the impeller hub 12 which is furthest from the suction section, i.e., where the fluid is in "transition" between the suction and discharge ends of casing 20.

An exemplary embodiment is shown in combined FIGS. 1 and 2. Here, the shaft 11 extends beyond the transition section 15 of the impeller hub 12 (extension not shown). The impeller 10 is rotatably mounted within casing 20 in the conically shaped suction cavity 23 and is supported by bearings 29 and 30, which may be of any suitable type.

Here, the casing 20 is designed so as to form two internal cavities: the conically shaped suction cavity 23, enclosed by suction casing wall 21, which diverges conically from the intake port 27, and the conically shaped discharge cavity 25, enclosed by discharge casing wall 22, which converges conically from suction cavity 23 towards discharge port 28. The stationary conical discharge hub 24 converges conically in a manner similar to discharge cavity 25 and is designed to fit within discharge cavity 25 with a predetermined annular space between the discharge hub 24 and the discharge casing wall 22. The discharge hub 24 is centrally mounted such that its axis is in line with the axis of impeller 10. The mounting is accomplished in this embodiment via stationary discharge vanes 26 which bridge the annular gap between the discharge hub 24 and the discharge casing wall 22. The diameter of the discharge hub 24 in the plane of its junction with the suction casing wall 21 is the same as the maximum diameter of impeller hub 12, i.e., the diameter of the impeller hub 12 at the end of the transition section 15.

In the embodiment as shown in FIGS. 1 and 2, the vanes 13 extend generally divergently along the outer surface of the impeller hub 12 and are of decreasing height along the length of the vane 13. Preferably, in this embodiment, the vanes 13 decrease in height such that the height at the transition section 15 is approximately 31% of the height at the suction section 14. "Divergently" relates to the direction and placement of the vanes 13 on or in relation to a conic structure, i.e., vanes 13 having the axial and radial components of a related conic structure.

FIG. 1 shows one embodiment of the vanes 13. Here, the vanes 13, towards the divergent end, are axially bowed back in a direction opposite that of the direction of rotation. Further, the vanes 13 have a helical twist, opposed to the direction of rotation. Still further, considering an incremental axial section of a vane 13, the vanes 13 are curved with a center of curvature to the left of the vane 13 as shown in FIG. 1 for the indicated direction of rotation.

The combination of FIGS. 1 and 2 generally illustrates a submersible pump according to the present invention. In use, the fluid enters intake port 27 and contacts the suction section 14 of impeller hub 12 and vanes 13. The shape of the rotating vanes 13, i.e., bowed back in a direction opposite that of the direction of rotation, causes the fluid to advance axially and radially along the conically shaped impeller hub 12. As the fluid approaches the transition section 15 of impeller hub 12, it is believed that the fluid has a significantly increased velocity without a significantly increased pressure. The fluid flows from the transition section 15 into the discharge cavity 25 and flows through channels defined by the annular space between discharge casing wall 22 and discharge hub 24 and between stationary discharge vanes 26. The fluid exits the casing at discharge port 28 with a significantly increased velocity.

Figure 5:
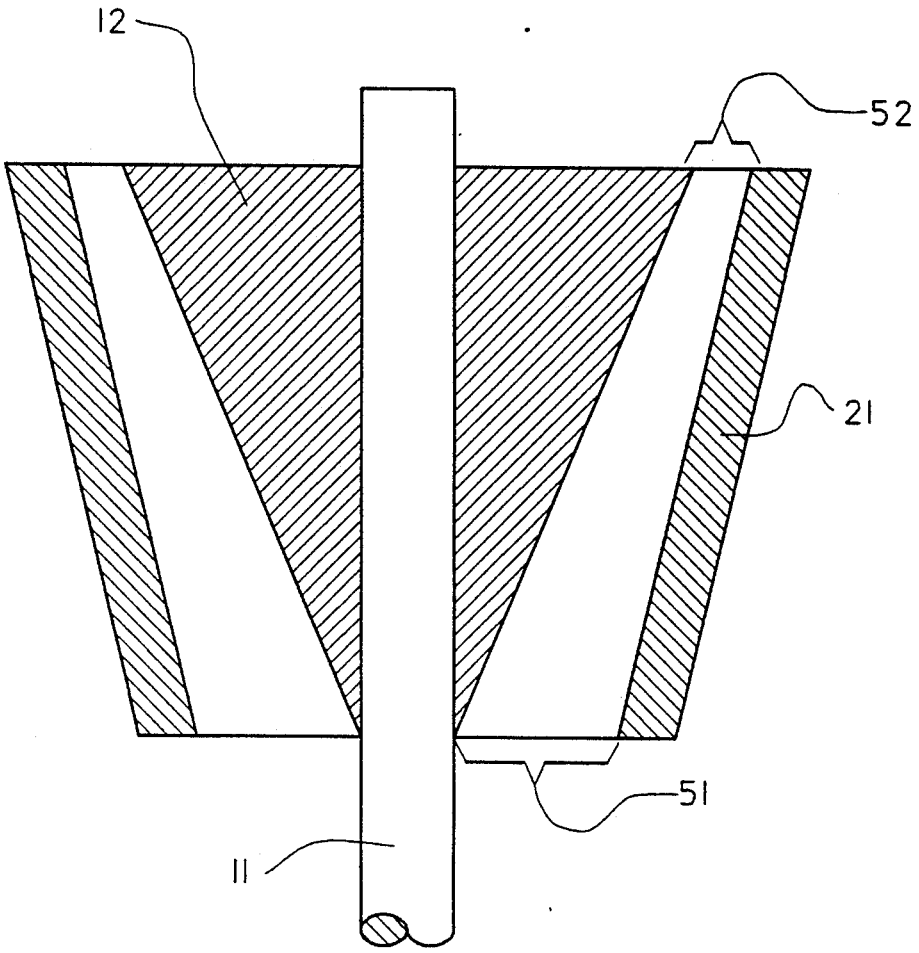
FIG. 5 is a schematic view of the impelling device showing the relationship between the impeller hub and the suction cavity at the suction section and at the transition section of the impeller hub.

The conically shaped suction cavity 23 and conically shaped impeller hub 12 are designed such that the incremental volume between the suction casing wall 21 and impeller hub 12 at the suction section 14 of the impeller hub 12 is greater than or equal to the incremental volume at the transition section 15 of the impeller hub 12, i.e., the cross-sectional area of the annular space between the suction section 14 of the impeller hub 12 and the casing 21 adjacent the suction section 14 is at least equal to the cross-sectional area of the annular space between the transition section 15 of the impeller hub 12 and the casing 21 adjacent the transition section 15. "Incremental volume" is the difference in cross-sectional areas between the inner surface of the suction casing wall 21 and the outer surface of the impeller hub 12 multiplied by an incremental length. "Incremental volume" may be better understood with reference to FIG. 5. The incremental volume at the suction section 14 (see FIG. 1) may be calculated by utilizing the suction section annular gap 51 to determine the cross-sectional area at the suction section 14. The cross-sectional area at the suction section annular gap 51 is multiplied by a unit length to calculate the incremental volume. It is believed that to reduce or eliminate cavitation, the incremental volume at the suction section annular gap 51 should be greater than or equal to the incremental volume at the transition section annular gap 52. It is believed that designing these elements such that the incremental volume at the suction section 14 is greater than or equal to the incremental volume at the transition section 15 will reduce the occurrence of cavation. It is believed that, if the incremental volume were allowed to increase from the suction section 14 to the transition section 15, cavitation would be more likely to occur.

As the fluid, pushed by rotating vanes 13, moves axially and radially along impeller hub 12 in the direction of flow, the fluid's velocity is increased due to the constant rotational speed and the fluid's increased distance from the axis of rotation, thus producing radial and axial acceleration. Because the impeller hub 12 diverges conically from the suction section 14, the incremental velocity of the vanes 13 increases from the suction section 14 to the transition section 15. Thus, the fluid is accelerated uniformly as it moves axially and radially from the suction section 14 to the transition section 15 of impeller hub 12. It is believed that uniform acceleration serves to reduce cavitation.

Figure 4:
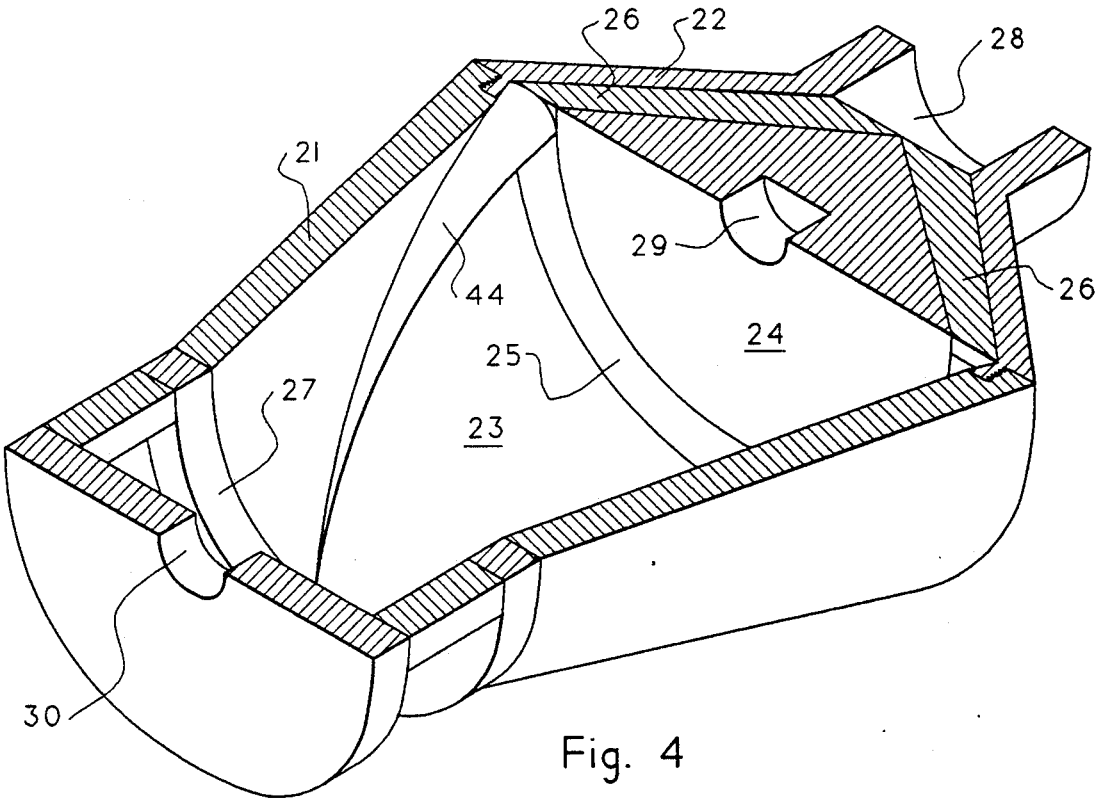
FIG. 4 is an alternate embodiment of the casing of FIG. 2, wherein the suction cavity contains multiple stator blades.

As the fluid proceeds past the transition section 15, the fluid is forced through channels defined by the annular space between discharge casing wall 22 and discharge hub 24 and between stationary discharge vanes 26. FIGS. 2 and 4 show one embodiment of the discharge vanes 26 wherein the discharge vanes 26 are generally straight in both the axial and radial directions. The discharge vanes 26 thus force the fluid into separate channels around the periphery of the discharge hub 24, effectively eliminating the rotational component of the flow. This discharge arrangement results in a high velocity discharge flow stream which is also highly directional.

Figure 3:
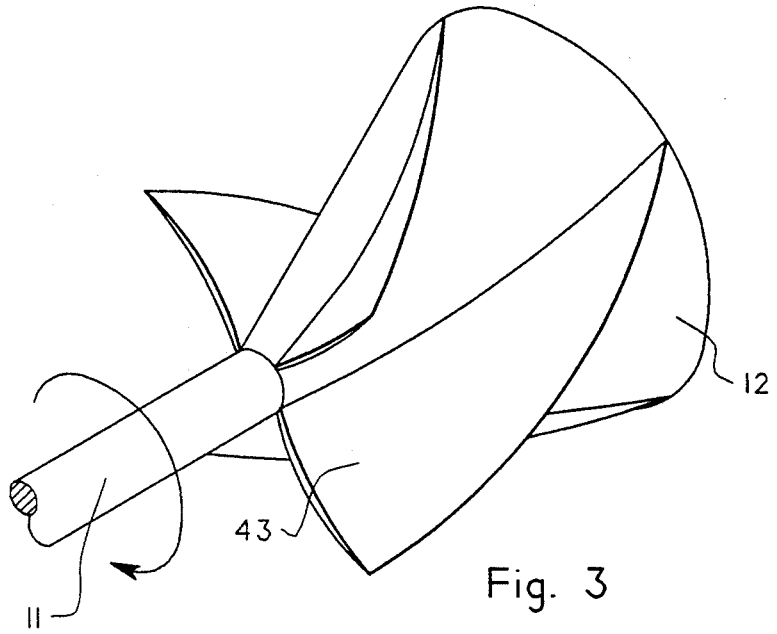
FIG. 3 is an alternate embodiment of the impeller of FIG. 1.

The present invention is also exemplified by an alternative configuration shown in combined FIGS. 3 and 4. This preferred embodiment is different from the previously discussed embodiment in regards to the shape of vanes 43 and the addition of stator blades 44. This embodiment would be used when a higher rate of flow and a higher velocity are desired. Here, the vanes 43 have the same general shape as the vanes 13 of FIG. 1 except that the height of the vanes 43 progressively decrease in the direction of flow such that the height of the vanes 43 decrease to zero at the transition section 15.

A plurality of stator blades 44 are attached to the interior of the suction casing wall 21 and protrude into the suction cavity 23. The stator blades 44 increase in height in the direction of flow and are designed such that their edges are in close proximity to the trailing edges of the rotating vanes 43. The stator blades 44 are attached to the inner surface of suction casing wall 21 in a generally divergent direction with a bow towards the divergent end, the bow being back in the direction of rotation. In relation to the inner surface of suction casing wall 21, the stator blades 44 are angled into the direction of rotation so as to scoop into the circular flow produced by rotating vanes 43. Considering an incremental axial section of a stator blade 44, the stator blades 44 are curved with a center of curvature to the right of the stator blade 44 as shown in FIG. 4 for the direction of rotation indicated in FIG. 3. Preferably, the stator blades 44 are located such that the divergent end is in-line with a corresponding discharge vane 26 in order to minimize turbulence in the transition section 15. (See meeting of stator blade 44 and discharge vane 26 in FIG. 4.)

The impelling apparatus of the present invention is a very versatile apparatus with varying embodiments employing the inventive concepts noted above.

The discharge cavity 25 and discharge hub 24 may be designed such that there is a progressively decreasing cross-sectional area in the annular space between the discharge casing wall 22 and the discharge hub 24 in the direction of flow such that the discharge configuration acts as a nozzle further increasing the fluid's velocity. This design would typically be used in a propulsion situation, such as a jet ski.

FIGS. 2 and 4 show casings 20 wherein the exterior shape is diverging conical-converging conical. However, any exterior shape may be used, e.g. cylindrical.

The embodiments discussed thus far have a shaft 11 which extends through intake port 27. However, the shaft 11 could extend through discharge port 28, through discharge hub 24 (if discharge hub 24 is desired) to impeller hub 12. Such a configuration would be used for a "line shaft turbine" as are used in irrigation systems.

The embodiment of FIGS. 2 and 4 could be designed without stationary discharge vanes 26. In this circumstance, discharge hub 24 would be centrally mounted via other means. Also, the stationary discharge vanes 26 may be shaped such that the end at transition section 15 is curved into the circular flow produced by rotating vanes 13, 43, with the end toward discharge port 28 generally straight. This design would facilitate the conversion of rotational velocity to axial velocity.

For jet pump drives, such as for watercraft, the casing 20 could be designed without bearing 30 and the shaft 11 would be otherwise supported. This would allow water to enter intake port 27 with less obstructions.

The device of the present invention could be designed to facilitate piping connections to the intake port 27 and/or discharge port 28. In this circumstance, the device would operate as a pump.

The vane 13, 43 shape and size as well as the number of vanes 13, 43 could be altered depending upon the effect to be achieved. FIGS. 1 and 3 show one general shape of vanes 13, 43. However, the vanes 13, 43 may be shaped so as to achieve any predetermined objective. For example, the vanes 13, 43 may be shaped such that they are axially bowed back in a direction opposite that of the direction of rotation while being generally straight in the radial direction.

EXAMPLE

An impelling device was built and tested as follows:

The intake port 27 I.D. was 2.75 in. The discharge port 28 I.D. was 2.75 in. The diameter of impeller hub 12 at transition section 15 was 2.375 in. The overall casing 20 length was 6.563 in. The device had 4 stator blades 44 and 4 stationary vanes 26. Two embodiments of the device were tested; one embodiment having 3 vanes 13, the second embodiment having 6 vanes 13. Both the suction section and discharge section had an annular space of constant cross-sectional area.

Figure 6:
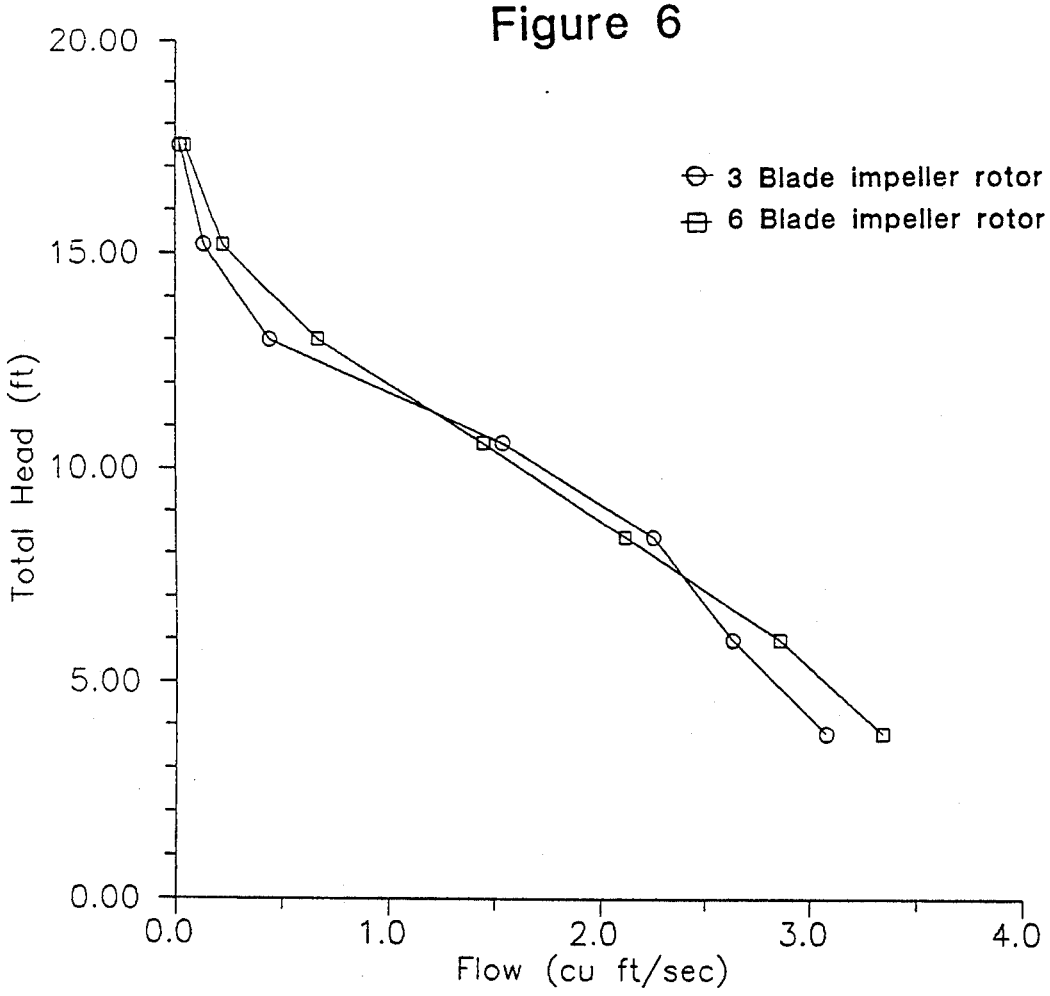
FIG. 6 is a graph of pump head versus flow rate for an impelling device of the present invention.

The device was submerged to a depth of 4 ft. The device was powered by a 1.5 horsepower electric motor with a maximum speed of 3450 RPM. The discharge of the device was routed through a 4 in. I.D. pipe to a level of 48 in. above the water surface. A valve was incorporated before the flow discharge with a pressure gauge located just upstream of the valve. The flow rate was determined for a number of discharge pressure settings (expressed in feet of head) as shown in FIG. 6.

The impelling device of this inventions solves the problems mentioned above by providing an impelling device which provides a high velocity stream without a significant pressure differential which operates in a manner so as to reduce or eliminate cavation.

Having described the invention above, various modifications of the techniques, procedures, materials and equipment will be apparent to those skilled in the art. It is intended that all such variations within the scope and spirit of the invention be included within the scope of the appended claims.

What is claimed is:

1. An impelling apparatus for impelling a fluid, comprising:

a suction casing, including an axially located intake port, having a conically shaped suction cavity which diverges conically from the intake port;

a plurality of stator blades having divergent ends, said stator blades being attached to the suction casing, extending into the suction cavity, and extending divergently from the intake port; and an impeller, rotatably mounted about an axis within said conically shaped suction cavity, including a conically shaped impeller hub having a suction section, a transition section, and an outer surface, wherein the impeller hub diverges conically in an axial direction from the suction section to the transition section, and a plurality of vanes having divergent ends, extending radially outward from the outer surface of the impeller hub and extending divergently along the outer surface of the impeller hub from the suction section to the transition section;

wherein the radial extension of the vanes from the axis is equal to the radius of the impeller hub at the transition section and the radial dimension of the vanes from the outer surface of the impeller hub decreases to zero at the transition section;

wherein the cross-sectional area of the annular space between the suction section of the impeller hub and the casing adjacent the suction section is at least equal to the cross-sectional area of the annular space between the transition section of the impeller hub and the casing adjacent the transition section.

2. The impelling apparatus of claim 1, further comprising:

a discharge casing extending axially from the suction casing, including an axially located discharge port, having a conically shaped discharge cavity which converges conically in an axial direction from the suction cavity to the discharge port; and a conically shaped discharge hub mounted within the discharge cavity which converges conically in an axial direction from the suction cavity towards the discharge port.

3. The impelling apparatus of claim 2, wherein the divergent ends of the vanes are bowed back in a direction opposite that of the direction of rotation.

4. The impelling apparatus of claim 2, wherein the divergent ends of the stator blades are bowed back in the direction of rotation.

5. The impelling apparatus of claim 2, further comprising a plurality of stationary discharge vanes attached to both the discharge casing and the discharge hub, bridging an annular space between the discharge casing and the discharge hub.

6. The impelling apparatus of claim 5, wherein the discharge vanes are straight in both the radial and axial directions.

* * * * *